US008989396B2

(12) United States Patent
Kambe

(10) Patent No.: US 8,989,396 B2
(45) Date of Patent: Mar. 24, 2015

(54) AUDITORY DISPLAY APPARATUS AND AUDITORY DISPLAY METHOD

(75) Inventor: Nobuhiro Kambe, Kanagawa (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 597 days.

(21) Appl. No.: 13/383,073

(22) PCT Filed: Apr. 27, 2011

(86) PCT No.: PCT/JP2011/002478
§ 371 (c)(1),
(2), (4) Date: Jan. 9, 2012

(87) PCT Pub. No.: WO2011/148570
PCT Pub. Date: Dec. 1, 2011

(65) Prior Publication Data

US 2012/0106744 A1 May 3, 2012

(30) Foreign Application Priority Data

May 28, 2010 (JP) ..... 2010-123352

(51) Int. Cl.
*H04R 29/00* (2006.01)
*H04S 7/00* (2006.01)
*H04S 3/00* (2006.01)

(52) U.S. Cl.
CPC .... *H04S 7/00* (2013.01); *H04S 3/00* (2013.01)
USPC ..... 381/56; 700/94; 700/61

(58) Field of Classification Search
USPC ..... 381/17, 23, 56, 62, 73.1, 98, 119, 314; 700/94
See application file for complete search history.

(56) References Cited

U.S. PATENT DOCUMENTS 5,438,623 A * 8/1995 Begault ..... 381/17
5,736,982 A 4/1998 Suzuki et al.

(Continued)

FOREIGN PATENT DOCUMENTS

CN 101110215 A 1/2008
CN 101622659 A 1/2010

(Continued)

OTHER PUBLICATIONS

International Search Report issued May 31, 2011 in corresponding International Application No. PCT/JP2011/002478.

(Continued)

*Primary Examiner* — Xu Mei
*Assistant Examiner* — Friedrich W Fahnert
(74) *Attorney, Agent, or Firm* — Wenderoth, Lind & Ponack, L.L.P.

(57) ABSTRACT

An auditory display apparatus is provided that places sounds such that sounds whose fundamental frequencies are close to each other are not adjacent to each other. A sound transmission/reception section receives sound data. A sound analysis section analyzes the sound data, and calculates a fundamental frequency of the sound data. A sound placement section compares the fundamental frequency of the sound data with a fundamental frequency of adjacent sound data, and places the sound data such that a difference in fundamental frequency is maximized. A sound management section manages a placement position of the sound data. A sound mixing section mixes the sound data with the adjacent sound data. A sound output section outputs the sound data obtained by the mixture to a sound output device.

13 Claims, 14 Drawing Sheets

(56) References Cited

U.S. PATENT DOCUMENTS

| | | | | |
|---|---|---|---|---|
| 2008/0019531 | A1 | 1/2008 | Kimijima | |
| 2009/0060207 | A1 * | 3/2009 | Barry et al. | 381/17 |
| 2010/0131086 | A1 * | 5/2010 | Itoyama et al. | 700/94 |
| 2010/0250257 | A1 | 9/2010 | Hirose et al. | |

FOREIGN PATENT DOCUMENTS

| | | |
|---|---|---|
| JP | 4-251294 | 9/1992 |
| JP | 8-130590 | 5/1996 |
| JP | 8-186648 | 7/1996 |
| JP | 11-252699 | 9/1999 |
| JP | 2000-81900 | 3/2000 |
| JP | 2001-5477 | 1/2001 |
| JP | 2005-184621 | 7/2005 |
| JP | 2008-166976 | 7/2008 |
| WO | 2008/149547 | 12/2008 |
| WO | 2009/112980 | 9/2009 |

OTHER PUBLICATIONS

Search Report dated Jan. 12, 2014 in corresponding Chinese Application No. 2011800028641.

* cited by examiner

| | |
|---|---|
| SOUND-TRANSMISSION DESTINATION | SOUND STORAGE DEVICE 203 |
| SOUND-TRANSMISSION SOURCE | SOUND INPUT DEVICE 201 |
| CHANNEL LIST | {123-456-789, 234-567-890, 34-5678-901, 34-5678-902} |
| CHANNEL NUMBER | 1 |
| USER ID | 987654321 |

FIG. 2B

| | |
|---|---|
| SOUND-TRANSMISSION DESTINATION | SOUND STORAGE DEVICE 203 |
| SOUND-TRANSMISSION SOURCE | SOUND INPUT DEVICE 201 |
| CHANNEL NUMBER | 2 |

FIG. 2C

| | |
|---|---|
| SOUND-TRANSMISSION DESTINATION | SOUND OUTPUT DEVICE 202 |
| SOUND-TRANSMISSION SOURCE | SOUND STORAGE DEVICE 203 |
| CHANNEL NUMBER | 1 |

FIG. 2D

| | |
|---|---|
| SOUND-TRANSMISSION DESTINATION | SOUND OUTPUT DEVICE 202 |
| SOUND-TRANSMISSION SOURCE | SOUND STORAGE DEVICE 203 |
| CHANNEL NUMBER | 2 |

FIG. 2E

| | |
|---|---|
| SOUND-TRANSMISSION DESTINATION | SOUND OUTPUT DEVICE 202 |
| SOUND-TRANSMISSION SOURCE | SOUND INPUT DEVICE 201<br>SOUND STORAGE DEVICE 203 |
| CHANNEL NUMBER | 3 |

FIG. 3A

| MANAGEMENT NUMBER | AZIMUTH ANGLE (DEGREE) | ELEVATION/ DEPRESSION ANGLE (DEGREE) | RELATIVE DISTANCE | OUTPUT STATE | FUNDAMENTAL FREQUENCY (Hz) |
|---|---|---|---|---|---|
| 1 | 0 | 0 | 1 | 1 | 220 |
| 2 | 90 | 0 | 1 | 1 | 150 |
| 3 | -90 | 0 | 1 | 1 | 250 |

FIG. 3B

| MANAGEMENT NUMBER | AZIMUTH ANGLE (DEGREE) | ELEVATION/ DEPRESSION ANGLE (DEGREE) | RELATIVE DISTANCE | OUTPUT STATE | FUNDAMENTAL FREQUENCY (Hz) | SOUND SOURCE INFORMATION |
|---|---|---|---|---|---|---|
| 1 | 0 | 0 | 1 | 1 | 220 | A |
| 2 | 90 | 0 | 1 | 1 | 150 | B |
| 3 | -90 | 0 | 1 | 1 | 250 | C |

FIG. 3C

| MANAGEMENT NUMBER | AZIMUTH ANGLE (DEGREE) | ELEVATION/ DEPRESSION ANGLE (DEGREE) | RELATIVE DISTANCE | OUTPUT STATE | FUNDAMENTAL FREQUENCY (Hz) | INPUT TIME |
|---|---|---|---|---|---|---|
| 1 | 0 | 0 | 1 | 1 | 220 | 18:45 |
| 2 | 90 | 0 | 1 | 1 | 150 | 18:46 |
| 3 | -90 | 0 | 1 | 1 | 250 | 19:10 |

FIG. 4A

| CHANNEL NUMBER | SOUND DATA | ATTRIBUTION INFORMATION |
|---|---|---|
| 1 | SOUND DATA A, SOUND DATA B | ENTIRE AREA |
| 2 | SOUND DATA C | |
| 3 | SOUND DATA D | |

FIG. 4B

| SOUND DATA | USER ID | INPUT TIME |
|---|---|---|
| SOUND DATA A | 987654321 | 2010/01/02 12:34 |
| SOUND DATA B | 789123456 | 2010/01/02 12:34 |
| SOUND DATA C | 345678912 | 2010/01/02 12:34 |
| SOUND DATA D | 234567891 | 2010/01/02 12:35 |

AUDITORY DISPLAY APPARATUS AND AUDITORY DISPLAY METHOD

TECHNICAL FIELD

The present invention relates to an auditory display apparatus that stereophonically places and outputs sounds so as to enable a plurality of sounds to be easily distinguished from each other at the same time.

BACKGROUND ART

In recent years, mobile phones which are among mobile devices have functions of transmitting/receiving electronic mails and allowing websites to be browsed, in addition to performing conventional voice communication, and communication methods and services in a mobile environment are becoming diversified. In the current mobile environment, operation methods based on visual sense are mainly used in the functions of transmitting/receiving electronic mails and allowing websites to be browsed. However, in such operation methods based on visual sense, although a great amount of information is provided and intuitive understandability is enhanced, danger may be involved in a moving state, for example, during walking or while a car is being driven.

Meanwhile, voice communication based on auditory sense, which is a primary function of mobile phones, has been established as communication means. In practice, however, because of constraints for securing a stable communication path, the service for voice communication is restricted so as to obtain such a quality as to allow contents of the phone call to be understood, by, for example, using monophonic sounds having a narrowed bandwidth.

On the other hand, methods of providing information for auditory sense have been conventionally studied, and a method of providing information by means of sounds is called an auditory display. An auditory display incorporating stereophonic technology makes it possible to offer information with enhanced presence, by placing the information as a sound at an optional position in a three-dimensional audio image space.

For example, Patent Literature 1 discloses technology in which the voice of a user's communication partner who is a speaking person is placed in a three-dimensional audio image space in accordance with the position of the partner and the direction in which the user faces. It is considered that this technology can be used as means for identifying, without shouting, a direction in which the partner is located when the partner cannot be found in a crowd.

In addition, Patent Literature 2 discloses technology in which the voice of a speaking person is placed such that the voice comes from a position at which an image of the speaking person is projected in a television conference system. It is considered that this technology makes it easy to find a speaking person in a television conference, and thus enables natural communication to be realized.

People are surrounded by a large number of sounds and hear a large number of sounds daily. The ability of people to selectively recognize contents to which they pay attention among a large number of sounds is known as cocktail party effect. That is, to some extent, people can selectively follow and listen to contents to which they pay attention even when a plurality of speaking persons are present at the same time. For example, multichannel television sound is in practical use as technology for simultaneously representing a plurality of speaking persons.

Further, Patent Literature 3 discloses technology in which the state of conversation in a virtual space is dynamically determined, and the voice of a specific communication partner and the voices of other speaking persons which are environmental sounds are placed.

Further, Patent Literature 4 discloses technology in which a plurality of sounds are placed in a three-dimensional audio image space and the plurality of sounds are heard as stereophonic sounds generated by convolution.

CITATION LIST

Patent Literature

Patent Literature 1: Japanese Laid-Open Patent Publication No. 2005-184621

Patent Literature 2: Japanese Laid-Open Patent Publication No. H8-130590

Patent Literature 3: Japanese Laid-Open Patent Publication No. H8-186648

Patent Literature 4: Japanese Laid-Open Patent Publication No. H11-252699

SUMMARY OF THE INVENTION

Problems to be Solved by the Invention

However, the conventional auditory display apparatuses as described above have the following problems. According to each of Patent Literature 1 and Patent Literature 2, a sound source is placed in accordance with the position of a speaking person, but there is a possibility that an undesirable situation arises when there are a plurality of speaking persons. Specifically, in Patent Literature 1 and Patent Literature 2, a problem arises that when the directions in which a plurality of speaking persons are located are close to each other, the voices of the plurality of speaking persons are heard overlapping each other, and thus are difficult to distinguish from each other.

In addition, in the multichannel television sound, a problem arises that, because two kinds of voices in different languages are respectively separated into right and left, and are broadcast, all voices of persons speaking one language come from one direction, and it is thus difficult to distinguish sounds of the one language from each other.

Further, in Patent Literature 3, a problem arises that, although the voice of a partner in communication state is heard loud and thus can be easily recognized, since voices of a plurality of other persons coexist as environmental sounds, it is difficult to distinguish voice of specific person among the voices of the plurality of other persons.

In addition, in Patent Literature 4, a problem arises that, since the characteristics of the voices of speaking persons are not taken into consideration, similar voices cannot be easily distinguished from each other when they are placed close to each other.

Therefore, the present invention has been made to solve the above problems, and an object of the present invention is to stereophonically place and output sounds, thereby enabling a desired sound to be easily recognized among a plurality of sounds.

Solution to the Problems

In order to attain the afore-mentioned object, an auditory display apparatus of the present invention includes: a sound transmission/reception section configured to receive sound data; a sound analysis section configured to analyze the sound data, and calculate a fundamental frequency of the sound data; a sound placement section configured to compare the fundamental frequency of the sound data with a fundamental frequency of adjacent sound data, and place the sound data such that a difference in fundamental frequency is maximized; a sound management section configured to manage a placement position of the sound data; a sound mixing section configured to mix the sound data with the adjacent sound data; and a sound output section configured to output the sound data obtained by the mixture to a sound output device.

The sound management section may manage the placement position of the sound data and sound source information of the sound data in combination with each other. In this case, the sound placement section determines, based on the sound source information, whether sound data received by the sound transmission/reception section is identical to sound data managed by the sound management section. If the sound placement section has determined that they are identical to each other, the sound placement section can place the received sound data at the same placement position as that of the sound data managed by the sound management section.

The sound management section may manage the placement position of the sound data and sound source information of the sound data in combination with each other. In this case, when the sound placement section places the sound data, the sound placement section can exclude, based on the sound source information, sound data that has been received from a specific input source.

In addition, the sound management section may manage the placement position of the sound data and an input time of the sound data in combination with each other. In this case, the sound placement section can place the sound data based on the input time of the sound data.

Preferably, when the sound placement section changes the placement position of the sound data, the sound placement section moves the sound data from a movement start position to a movement destination such that the position of the sound data changes stepwise between the movement start position and the movement destination.

The sound placement section places the sound data preferentially in an area including positions to the left and right of a user, and in front of the user. The sound placement section may place the sound data in an area including positions behind, or above and below the user.

In addition, the auditory display apparatus is connected to a sound storage device in which sound data corresponding to one or more sounds are stored. The sound storage device manages the sound data corresponding to the one or more sounds based on channels. In this case, the auditory display apparatus further includes an operation input section configured to receive an input for switching the channels, and a setting storage section configured to store a channel set by the switching. This allows the sound transmission/reception section to acquire sound data corresponding to the channel from the sound storage device.

In addition, the auditory display apparatus may further include an operation input section for acquiring a direction in which the auditory display apparatus faces. In this case, the sound placement section can change the placement position of the sound data in accordance with change in the direction in which the auditory display apparatus faces.

Further, the auditory display apparatus may include: a sound recognition section configured to convert sound data into character code, and calculate a fundamental frequency of the sound data; a sound transmission/reception section configured to receive the character code and the fundamental frequency of the sound data; a sound synthesis section configured to synthesize the sound data from the character code, based on the fundamental frequency; a sound placement section configured to compare the fundamental frequency of the sound data with a fundamental frequency of adjacent sound data, and place the sound data such that a difference in fundamental frequency is maximized; a sound management section configured to manage a placement position of the sound data; a sound mixing section configured to mix the sound data with the adjacent sound data; and a sound output section configured to output the sound data obtained by the mixture to a sound output device.

The present invention is also directed to a sound storage device connected to an auditory display apparatus. The sound storage device includes: a sound transmission/reception section configured to receive sound data; a sound analysis section configured to analyze the sound data, and calculate a fundamental frequency of the sound data; a sound placement section configured to compare the fundamental frequency of the sound data with a fundamental frequency of adjacent sound data, and place the sound data such that a difference in fundamental frequency is maximized; a sound management section configured to manage a placement position of the sound data; a sound mixing section configured to mix the sound data with the adjacent sound data, and transmit the sound data obtained by the mixture to the auditory display apparatus via the sound transmission/reception section.

In addition, the present invention may be implemented as a method performed by an auditory display apparatus connected to a sound output device. The method includes: a sound reception step of receiving sound data; a sound analysis step of analyzing the received sound data, and calculating a fundamental frequency of the sound data; a sound placement step of comparing the fundamental frequency of the sound data with a fundamental frequency of adjacent sound data, and placing the sound data such that a difference in fundamental frequency is maximized; a sound mixing step of mixing the sound data with the adjacent sound data; and a sound output step of outputting the sound data obtained by the mixture to the sound output device.

Advantageous Effects of the Invention

According to the auditory display apparatus of the present invention having the above features, sound data corresponding to a plurality of sounds can be placed such that the difference between sound data adjacent to each other is large. Therefore, desired sound data can be easily recognized.

BRIEF DESCRIPTION OF THE DRAWINGS

FIG. 2B shows an example of the setting information stored by the setting storage section 104 according to the first embodiment of the present invention.

FIG. 2C shows an example of the setting information stored by the setting storage section 104 according to the first embodiment of the present invention.

FIG. 2D shows an example of the setting information stored by the setting storage section 104 according to the first embodiment of the present invention.

FIG. 2E shows an example of the setting information stored by the setting storage section 104 according to the first embodiment of the present invention.

FIG. 3A shows an example of information managed by a sound management section 109 according to the first embodiment of the present invention.

FIG. 3B shows an example of the information managed by the sound management section 109 according to the first embodiment of the present invention.

FIG. 3C shows an example of the information managed by the sound management section 109 according to the first embodiment of the present invention.

FIG. 4A shows an example of information stored by a sound storage device 203 according to the first embodiment of the present invention.

FIG. 4B shows an example of the information stored by the sound storage device 203 according to the first embodiment of the present invention.

DESCRIPTION OF EMBODIMENTS

First Embodiment

Figures 1, 2A:
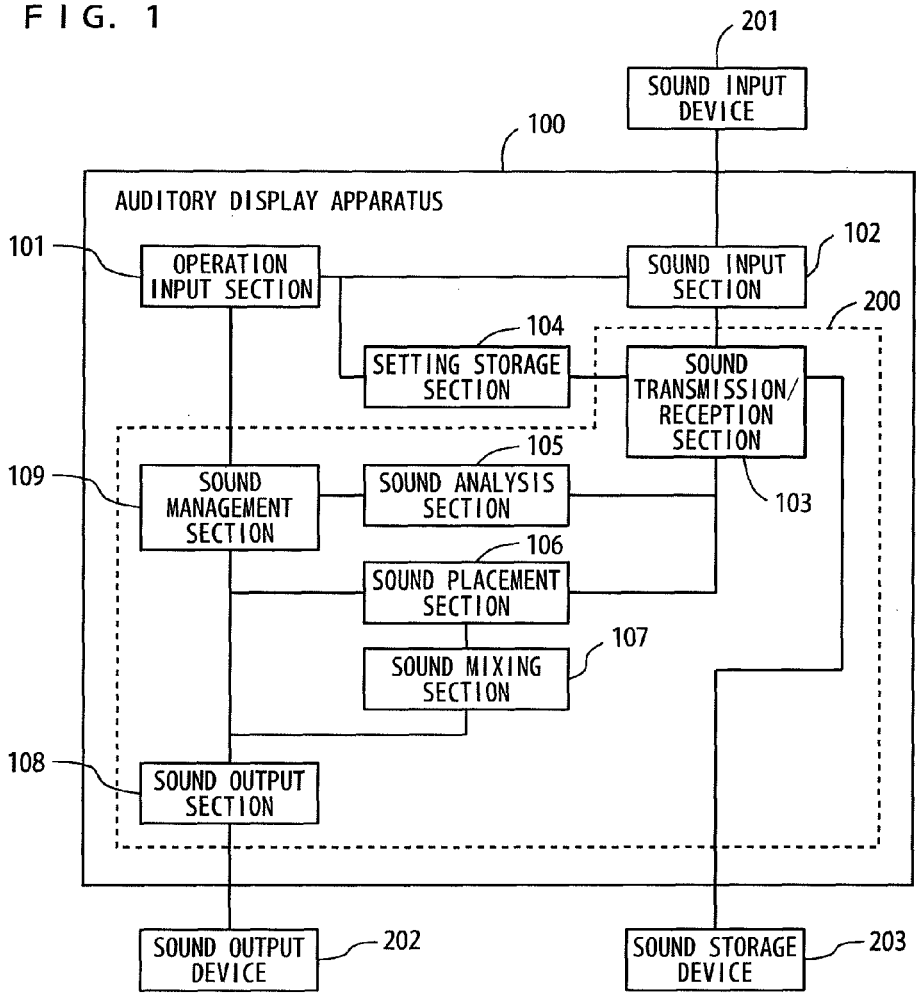
FIG. 1 is a block diagram showing an exemplary configuration of an auditory display apparatus 100 according to a first embodiment of the present invention.
FIG. 2A shows an example of setting information stored by a setting storage section 104 according to the first embodiment of the present invention.

FIG. 1 is a block diagram showing an exemplary configuration of an auditory display apparatus 100 according to a first embodiment of the present invention. In FIG. 1, the auditory display apparatus 100 receives a sound inputted from a sound input device 201, and stores, into a sound storage device 203, a sound (hereinafter, referred to as sound data) that has been converted into numerical data. In addition, the auditory display apparatus 100 acquires a sound stored in the sound storage device 203, and outputs the sound to a sound output device 202. In the present embodiment, the auditory display apparatus 100 is a mobile terminal for performing two-way audio communication.

The sound input device 201 is implemented as a microphone or the like, and converts air vibration of a sound into an electric signal. The sound output device 202 is implemented as stereo headphones or the like, and converts inputted sound data into air vibration. The sound storage device 203 is implemented as a file system, and is a database for storing sound data and attribution information about the sound data. The information stored in the sound storage device 203 will be described below with reference to FIGS. 4A and 4B.

In FIG. 1, the auditory display apparatus 100 is connected to the sound input device 201, the sound output device 202, and the sound storage device 203 that are external devices. However, the auditory display apparatus 100 may be configured to include each of these devices therein. For example, the auditory display apparatus 100 may include the sound input device 201. Further, the auditory display apparatus 100 may include the sound output device 202. In the case where the auditory display apparatus 100 includes the sound input device 201 and the sound output device 202, the auditory display apparatus 100 can be used as, for example, a stereo headset type mobile terminal.

In addition, the auditory display apparatus 100 may include the sound storage device 203. Alternatively, the sound storage device 203 may be on a communication network such as the Internet, and may be connected to the auditory display apparatus 100 via the communication network.

The function of the sound storage device 203 may be incorporated in another auditory display apparatus (not shown) different from the auditory display apparatus 100. That is, the auditory display apparatus 100 may be configured to transmit and receive sound data to and from another auditory display apparatus. The format of sound data may be a file format that enables collective transmission and reception, or may be a stream format that enables sequential transmission and reception.

Next, the configuration of the auditory display apparatus 100 will be described in detail. The auditory display apparatus 100 includes an operation input section 101, a sound input section 102, a sound transmission/reception section 103, a setting storage section 104, a sound analysis section 105, a sound placement section 106, a sound mixing section 107, a sound output section 108, and a sound management section 109. A sound placement processing section 200 includes the sound transmission/reception section 103, the sound analysis section 105, the sound placement section 106, the sound mixing section 107, the sound output section 108, and the sound management section 109. The sound placement processing section 200 has a function of placing sound data in a three-dimensional audio image space based on a fundamental frequency of the sound data.

The operation input section 101 includes a key button, a switch, a dial and the like, and receives an operation performed by a user, such as a sound transmission control, a channel selection, and a sound placement area setting. Alternatively, the operation input section 101 may include a remote controller and a controller receiving section. The remote controller receives a user operation, and transmits a signal corresponding to the user operation to the controller receiving section. The controller receiving section receives the signal corresponding to the user operation, and receives the operation performed by the user, such as a sound transmission control, a channel selection, and a sound placement area setting. The channel means a category such as a group related to a specific region, a group consisting of specific acquaintances, and a group for which a specific theme is defined.

The sound input section 102 includes an A/D converter and the like, and converts an electric signal of a sound into sound data which is numerical data. The setting storage section 104 includes a memory and the like, and stores various kinds of setting information about the auditory display apparatus 100. The setting information may be stored in the setting storage section 104 in advance. Alternatively, the setting information may be set by a user via the operation input section 101, and stored in the setting storage section 104. The setting information will be described below with reference to FIGS. 2A to 2E.

The sound transmission/reception section 103 includes a communication module, a device driver for file systems, and the like, and transmits and receives sound data and the like. The sound transmission/reception section 103 may compress and transmit sound data, and may receive and expand the compressed sound data.

The sound analysis section 105 analyzes sound data and calculates a fundamental frequency of the sound data. The sound placement section 106 places the sound data in a three-dimensional audio image space based on the fundamental frequency of the sound data. The sound mixing section 107 mixes the sound data placed in the three-dimensional audio image space with a stereophonic sound. The sound output section 108 includes a D/A converter and the like, and converts the sound data into an electric signal. The sound management section 109 stores and manages, as information about the sound data, a placement position of the sound data, an output state indicating whether the sound data continues to be outputted, the fundamental frequency, and the like. The information stored in the sound management section 109 will be described below with reference to FIGS. 3A to 3C.

FIG. 2A shows an example of the setting information stored by the setting storage section 104. In FIG. 2A, the setting storage section 104 stores, as the setting information, a sound-transmission destination, a sound-transmission source, a channel list, a channel number, and a user ID. The sound-transmission destination indicates a destination to which sound data inputted to the sound transmission/reception section 103 is transmitted. For example, the sound output device 202 and/or the sound storage device 203 are set as the sound-transmission destination. The sound-transmission source indicates a source from which sound data is inputted to the sound transmission/reception section 103. For example, the sound input device 201 and/or the sound storage device 203 are set as the sound-transmission source. The sound-transmission destination and the sound-transmission source may be represented in URI forms, or may be represented in other forms represented as IP addresses, phone numbers, or the like. In addition, a plurality of sound-transmission destinations and sound-transmission sources can be set. The channel list indicates a list of available channels, and a plurality of channels can be set. A channel number in the channel list to which a user is listening is set as the channel number. In the example shown in FIG. 2A, the channel number is "1". This means that the user is listening to a first channel "123-456-789" in the channel list.

Identification information of a user operating the auditory display apparatus 100 is set as the user ID. Identification information of the apparatus such as an apparatus ID or a MAC address may be set as the user ID. The use of the user ID makes it possible to exclude sound data that the apparatus has transmitted to the sound-transmission destination when placement of sound data received from the sound-transmission source is performed in the case where the sound-transmission destination and the sound-transmission source are the same. The above-described items and set values are only illustrative, and the setting storage section 104 can store other items and other set values. For example, the setting storage section 104 may store setting information as shown in FIGS. 2B to 2E. In FIG. 2B, the channel number is different from that in FIG. 2A. In FIG. 2C, the sound-transmission destination and the sound-transmission source are different from those in FIG. 2A. In FIG. 2D, the channel number is different from that in FIG. 2C. In FIG. 2E, another sound-transmission source is added, and the channel number is different from that in FIG. 2D.

FIG. 3A shows an example of information managed by the sound management section 109. In FIG. 3A, the sound management section 109 manages management numbers, azimuth angles, elevation/depression angles, relative distances, output states, and fundamental frequencies. Any numbers each corresponding to sound data are set as the management numbers such that the numbers are different from each other. The azimuth angle represents an angle from the front in the horizontal direction. In this example, the front in the horizontal direction at the initialization is represented as 0 degrees, the rightward direction is represented as positive, and the leftward direction is represented as negative. The elevation/depression angle represents an angle in the vertical direction from the front. In this example, the front in the vertical direction at the initialization is represented as 0 degrees, the vertically upward direction is represented as 90 degrees, and the vertically downward direction is represented as −90 degrees. The relative distance represents a distance from the front to sound data, and a value equal to or larger than 0 is set as the relative distance. The greater the value is, the longer the distance is. The azimuth angle, the elevation/depression angle, and the relative distance represent a placement position of sound data. The output state indicates whether a sound continues to be outputted. A state in which the output is continued is represented by 1, while a state in which the output has ended is represented by 0. As the fundamental frequency, a fundamental frequency of sound data which is obtained as a result of analysis by the sound analysis section 105 is set.

As shown in FIG. 3B, the sound management section 109 may manage information (hereinafter, referred to as sound source information) about input sources of the sound data, so as to be associated with the placement positions and the like of the sound data. The sound source information may contain information corresponding to the user ID described above. When having received new sound data, the sound placement section 106 can determine, by using the sound source information, whether the new sound data is identical to sound data managed by the sound management section 109. Further, when the new sound data is identical to sound data managed by the sound management section 109, the sound placement section 106 can set a placement position of the new sound data to be the same as that of the sound data under management. In addition, when performing sound data placement, the sound management section 109 can exclude sound data received from a specific input source by using the sound source information.

As shown in FIG. 3C, the sound management section 109 may manage input times indicating times at which the sound data have been inputted, so as to be associated with the placement positions and the like of the sound data. By using the input times, the sound placement section 106 can adjust the order of output of the sound data, and can place the sound data corresponding to a plurality of sounds in accordance with the intervals between the times. However, the placement may not necessarily be performed in accordance with the intervals between the times, and the placement of the sound data corresponding to the plurality of sounds may be shifted by a constant time. The above-described items and set values are only illustrative, and the sound management section 109 can store other items and other set values.

FIG. 4A shows an example of the information stored by the sound storage device 203. In FIG. 4A, the sound storage device 203 stores channel numbers, sound data, and attribution information. The sound storage device 203 can store sound data corresponding to a plurality of sounds, so as to be associated with one channel number. The attribution information is information indicating attributions such as a user ID which is identification information of a user who can listen to sound data, and an area in which a channel is available. The sound storage device 203 may not necessarily store channel numbers and attribution information. Further, as shown in FIG. 4B, the sound storage device 203 may store a user ID of a user who has inputted sound data, and an input time, so as to be associated with the sound data. Moreover, the sound storage device 203 may store a user ID and an input time, in addition to a channel number, sound data, and attribution information, so as to associate the user ID, the input time, the channel number, the sound data, and the attribution information with each other.

Figure 5:
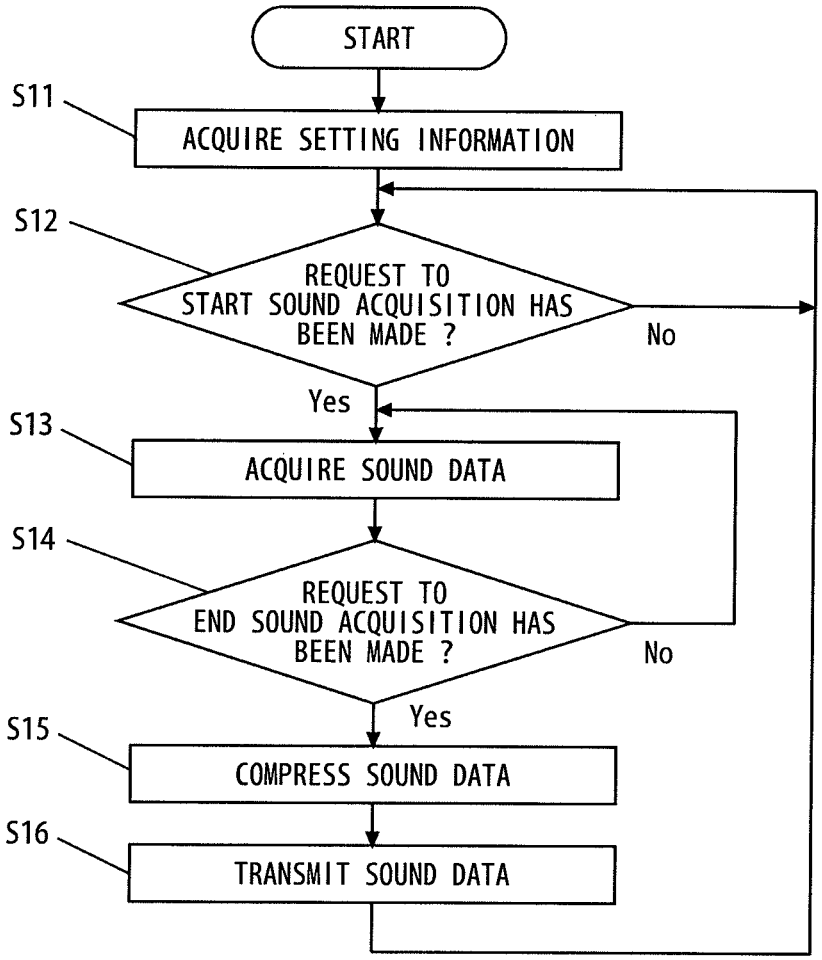
FIG. 5 is a flowchart showing an example of operations performed by the auditory display apparatus 100 according to the first embodiment of the present invention.

Operations of the auditory display apparatus 100 configured as described above will be described with reference to FIG. 5. FIG. 5 is a flowchart showing operations performed by the auditory display apparatus 100 according to the first embodiment when a sound inputted via the sound input device 201 is transmitted to the sound storage device 203. Referring to FIG. 5, when the auditory display apparatus 100 is activated, the sound transmission/reception section 103 acquires setting information from the setting storage section 104 (step S11). Here, it is assumed that as the setting information, the "sound storage device 203" is set as the sound-transmission destination, the "sound input device 201" is set as the sound-transmission source, and "2" is set as the channel number (see FIG. 2B). In the example shown in FIG. 2B, the use of the channel list and the user ID is omitted.

Subsequently, the operation input section 101 receives a request from a user to start sound acquisition (step S12). A request to start sound acquisition is made by the user performing an operation, such as pushing a button of the operation input section 101. Alternatively, it may be determined, at the time when a sensor has sensed an input sound, that a request to start sound acquisition has been made. When no request to start sound acquisition has been made (No at step S12), the flow of operations returns to step 12, and the operation input section 101 receives a request to start sound acquisition.

When a request to start sound acquisition has been made (Yes at step S12), the sound input section 102 receives, from the sound input device 201, a sound that has been converted into an electric signal, converts the received sound into numerical data, and then outputs the numerical data as sound data to the sound transmission/reception section 103. Thus, the sound transmission/reception section 103 acquires the sound data (step S13).

Subsequently, the operation input section 101 receives a request from the user to end sound acquisition (step S14). When no request to end sound acquisition has been made (No at step S14), the flow of operations returns to step S13, and the sound transmission/reception section 103 continues sound data acquisition. Alternatively, the sound transmission/reception section 103 may be configured to automatically end sound acquisition when a predetermined time period has elapsed from the start of sound acquisition.

The sound transmission/reception section 103 may temporarily store acquired sound data in a storage area (not shown) in order to continue sound data acquisition. In addition, the sound transmission/reception section 103 may automatically issue an request to end sound acquisition when the amount of acquired sound data has become so large that sound data cannot be stored further.

A request to end sound acquisition is made by the user releasing a button of the operation input section 101, or pushing again a button for starting sound acquisition. Alternatively, the operation input section 101 may determine, at the time when the sensor has no longer sensed an input sound, that a request to end sound acquisition has been made. When a request to end sound acquisition has been made (Yes at step S14), the sound transmission/reception section 103 compresses the acquired sound data (step S15). The compression of the sound data reduces the amount of data. The sound transmission/reception section 103 may omit the compression of the sound data.

Subsequently, the sound transmission/reception section 103 transmits the sound data to the sound storage device 203 (step S16), based on the setting information previously acquired. The sound storage device 203 stores the sound data transmitted by the sound transmission/reception section 103. Thereafter, the flow of operations returns to step S12, and the operation input section 101 receives a request to start sound acquisition again.

In the case where a destination to which sound data is transmitted, a channel and the like are fixedly set, the sound transmission/reception section 103 can transmit and receive sound data without acquiring the setting information from the setting storage section 104. Accordingly, the setting storage section 104 is not an essential component for the auditory display apparatus 100, and the operation at step S11 can be omitted. Similarly, in the case where, for example, settings need not be made for the setting storage section 104 by using the operation input section 101, the operation input section 101 is not an essential component for the auditory display apparatus 100.

Further, the sound transmission/reception section 103 may acquire sound data from not only the sound input section 102 but also a sound storage device 203 and the like. Accordingly, the sound input section 102 is not an essential component for the auditory display apparatus 100.

Next, operations of the auditory display apparatus 100 according to the first embodiment performed when mixing and outputting sound data will be described using several patterns as examples.

(First Pattern)

In a first pattern, a description will be given of operations that the auditory display apparatus 100 performs when acquiring, from the sound storage device 203, sound data corresponding to a plurality of sounds, and mixing and outputting the acquired sound data corresponding to the plurality of sounds. Here, it is assumed that as the setting information stored in the setting storage section 104, the "sound output device 202" is set as the sound-transmission destination, the "sound storage device 203" is set as the sound-transmission source, and "1" is set as the channel number (see FIG. 2C, for example). In the example shown in FIG. 2C, the use of the channel list and the user ID is omitted. The setting information may be stored in the setting storage section 104 in advance. Alternatively, the setting information may be set by a user via the operation input section 101, and stored in the setting storage section 104.

Figure 6:
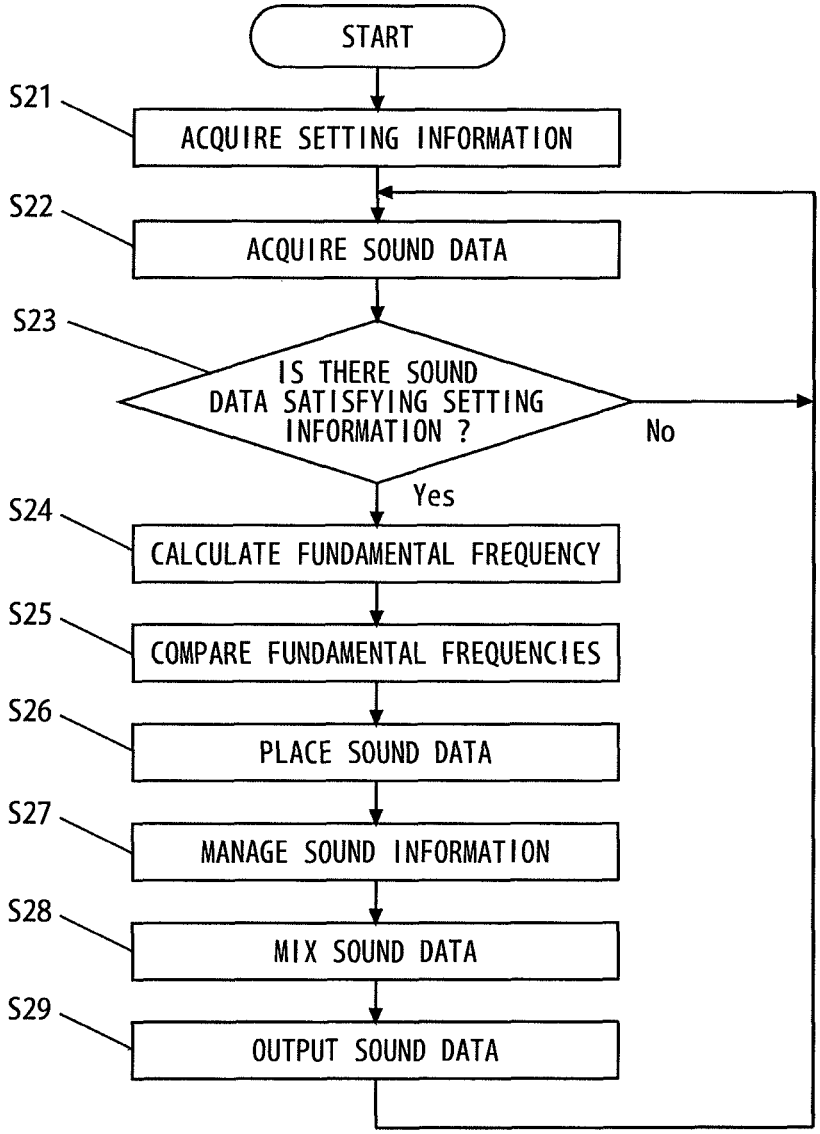
FIG. 6 is a flowchart showing an example of the operations performed by the auditory display apparatus 100 according to the first embodiment of the present invention.

FIG. 6 is a flowchart showing an example of operations that the auditory display apparatus 100 according to the first embodiment performs when mixing and outputting sound data corresponding to a plurality of sounds stored in the sound storage device 203. Referring to FIG. 6, when the auditory display apparatus 100 is activated, the sound transmission/reception section 103 acquires the setting information from the setting storage section 104 (step S21).

Subsequently, the sound transmission/reception section 103 transmits, to the sound storage device 203, the channel number "1" set in the setting storage section 104, and acquires sound data corresponding to the channel number from the sound storage device 203 (step S22). In the case where the sound storage device 203 has a retrieval function, the sound transmission/reception section 103 may transmit a keyword to the sound storage device 203, and acquire, from the sound storage device 203, sound data retrieved based on the keyword. In the case where the sound storage device 203 does not classify sound data based on channel numbers, the sound transmission/reception section 103 need not transmit a channel number to the sound storage device 203.

Subsequently, the sound transmission/reception section 103 determines whether sound data satisfying the setting information has been acquired from the sound storage device 203 (step S23). When the sound transmission/reception section 103 has not acquired sound data satisfying the setting information (No at step S23), the flow of operations returns to step S22. Here, it is assumed that the sound transmission/reception section 103 has acquired, from the sound storage device 203, sound data A and sound data B as sound data satisfying the setting information. When the sound data satisfying the setting information have been acquired, the sound analysis section 105 calculates fundamental frequencies of the acquired sound data A and sound data B (step S24). Next, the sound placement section 106 compares the calculated fundamental frequency of the sound data A with the calculated fundamental frequency of the sound data B (step S25), determines placement positions of the acquired sound data A and sound data B, and then places the sound data A and the sound data B (step S26). The method of determining a placement position of sound data will be described below.

Subsequently, the sound placement section 106 notifies the sound management section 109 of information including the placement positions, output states, and fundamental frequencies of the sound data. The sound management section 109 manages the information provided by the sound placement section 106 (step S27). The operation to be performed at step S27 may be performed after a subsequent step (after step S28 or after step S29). In addition, the sound mixing section 107 mixes the sound data A and the sound data B placed by the sound placement section 106 (step S28). The sound output section 108 outputs, to the sound output device 202, the sound data A and the sound data B mixed by the sound mixing section 107 (step S29). In parallel with this flow, a process of outputting the sound data from the sound output device 202 is separately performed. When the output of the sound data has ended, the information such as the output state managed by the sound management section 109 is updated.

Figure 7:
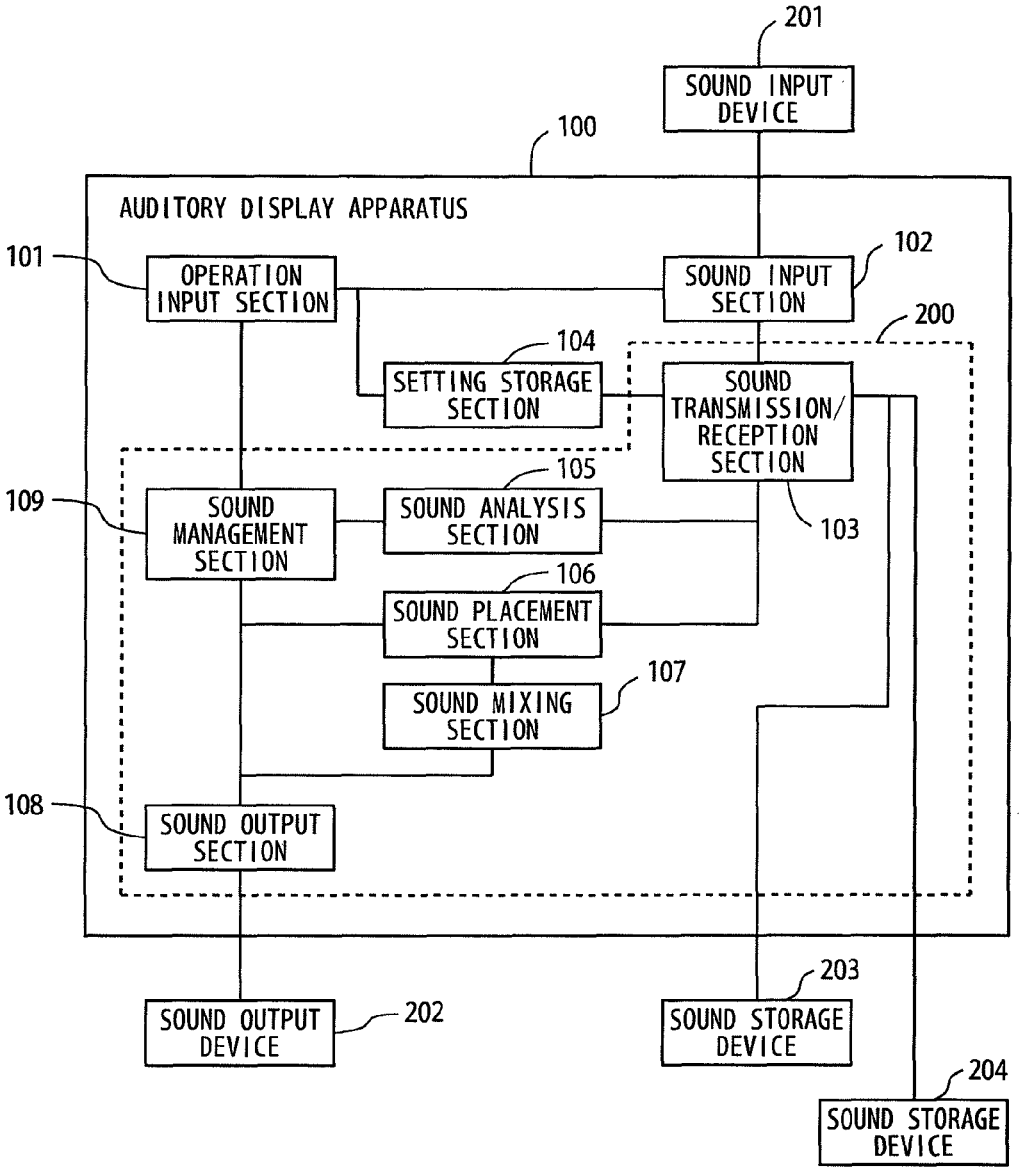
FIG. 7 is a diagram showing an example of the auditory display apparatus 100 to which a plurality of sound storage devices 203 and 204 are connected.

As shown in FIG. 7, the auditory display apparatus 100 may be connected to a plurality of sound storage devices 203 and 204, and may acquire, from the plurality of sound storage devices 203 and 204, sound data corresponding to a plurality of sounds.

(Second Pattern)

In a second pattern, a description will be given of operations that the auditory display apparatus 100 performs when mixing sound data acquired from the sound storage device 203 with sound data having been previously placed, and outputting the sound data obtained by the mixture to the sound output device 202. Here, it is assumed that as the setting information stored in the setting storage section 104, the "sound output device 202" is set as the sound-transmission destination, the "sound storage device 203" is set as the sound-transmission source, and "2" is set as the channel number (see FIG. 2D, for example). In addition, the sound data having been previously placed is represented as sound data X. The setting information may be stored in the setting storage section 104 in advance. Alternatively, the setting information may be set by a user via the operation input section 101, and stored in the setting storage section 104.

Figure 8:
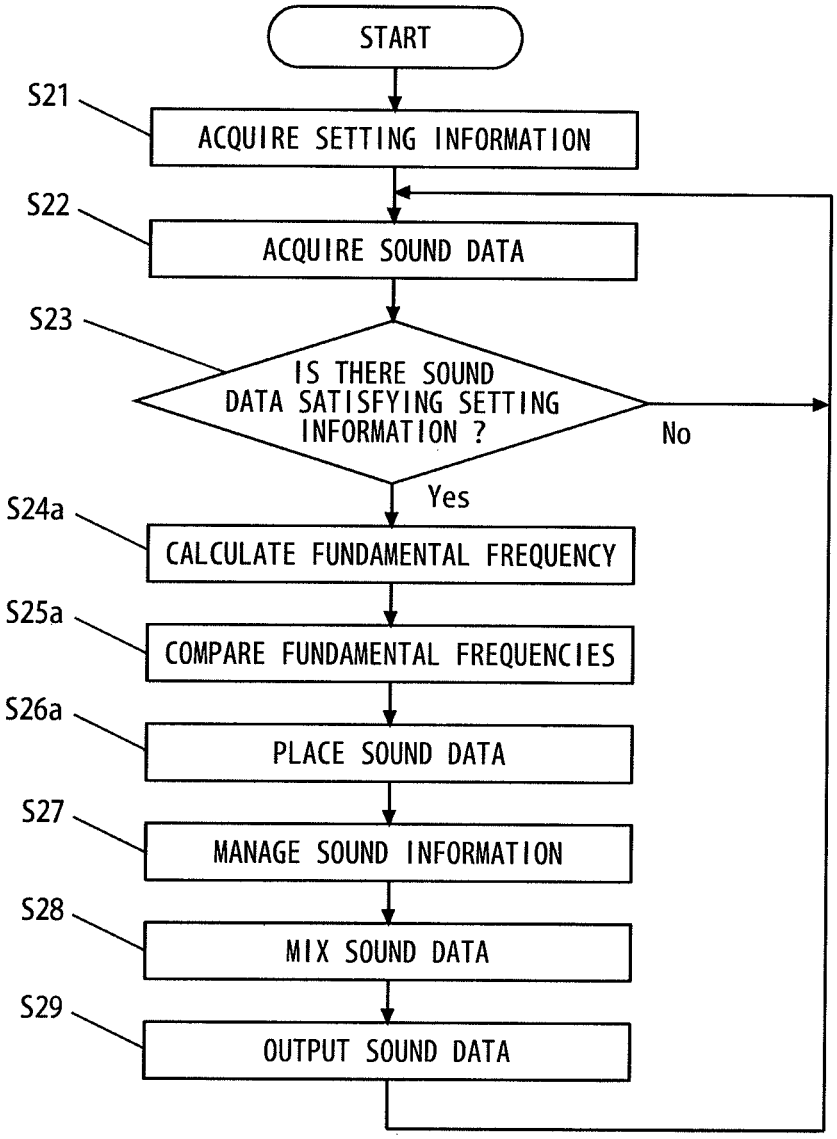
FIG. 8 is a flowchart showing an example of the operations performed by the auditory display apparatus 100 according to the first embodiment of the present invention.

FIG. 8 is a flowchart showing an example of operations that the auditory display apparatus 100 according to the first embodiment performs when mixing sound data acquired from the sound storage device 203 with sound data having been previously placed. Referring to FIG. 8, the operations at steps S21 to S23 are the same as shown in FIG. 6, and thus the description thereof is omitted. It is assumed that as a result of step S22, the sound transmission/reception section 103 has acquired, from the sound storage device 203, sound data C which is sound data satisfying the setting information. When the sound data satisfying the setting information has been acquired, the sound analysis section 105 calculates a fundamental frequency of the acquired sound data C (step S24*a*). Next, the sound placement section 106 compares the calculated fundamental frequency of the sound data C with a fundamental frequency of the previously-placed sound data X (step S25*a*), and determines placement positions of the sound data C and the sound data X (step S26*a*). At this time, the sound placement section 106 can obtain the fundamental frequency of the previously-placed sound data X by, for example, referring to the sound management section 109. The method of determining a placement position of sound data will be described below. The operations at steps S27 to S29 are the same as shown in FIG. 6, and thus the description thereof is omitted.

(Third Pattern)

In a third pattern, a description will be given of operations that the auditory display apparatus 100 performs when mixing and outputting sound data inputted from the sound input device 201 and sound data acquired from the sound storage device 203. Here, it is assumed that as the setting information stored in the setting storage section 104, the "sound output device 202" is set as the sound-transmission destination, the "sound input device 201" and the "sound storage device 203" are set as the sound-transmission sources, and "3" is set as the channel number (see FIG. 2E, for example). In addition, the sound data inputted from the sound input device 201 is represented as sound data Y. The setting information may be stored in the setting storage section 104 in advance. Alternatively, the setting information may be set by a user via the operation input section 101, and stored in the setting storage section 104.

Figure 9:
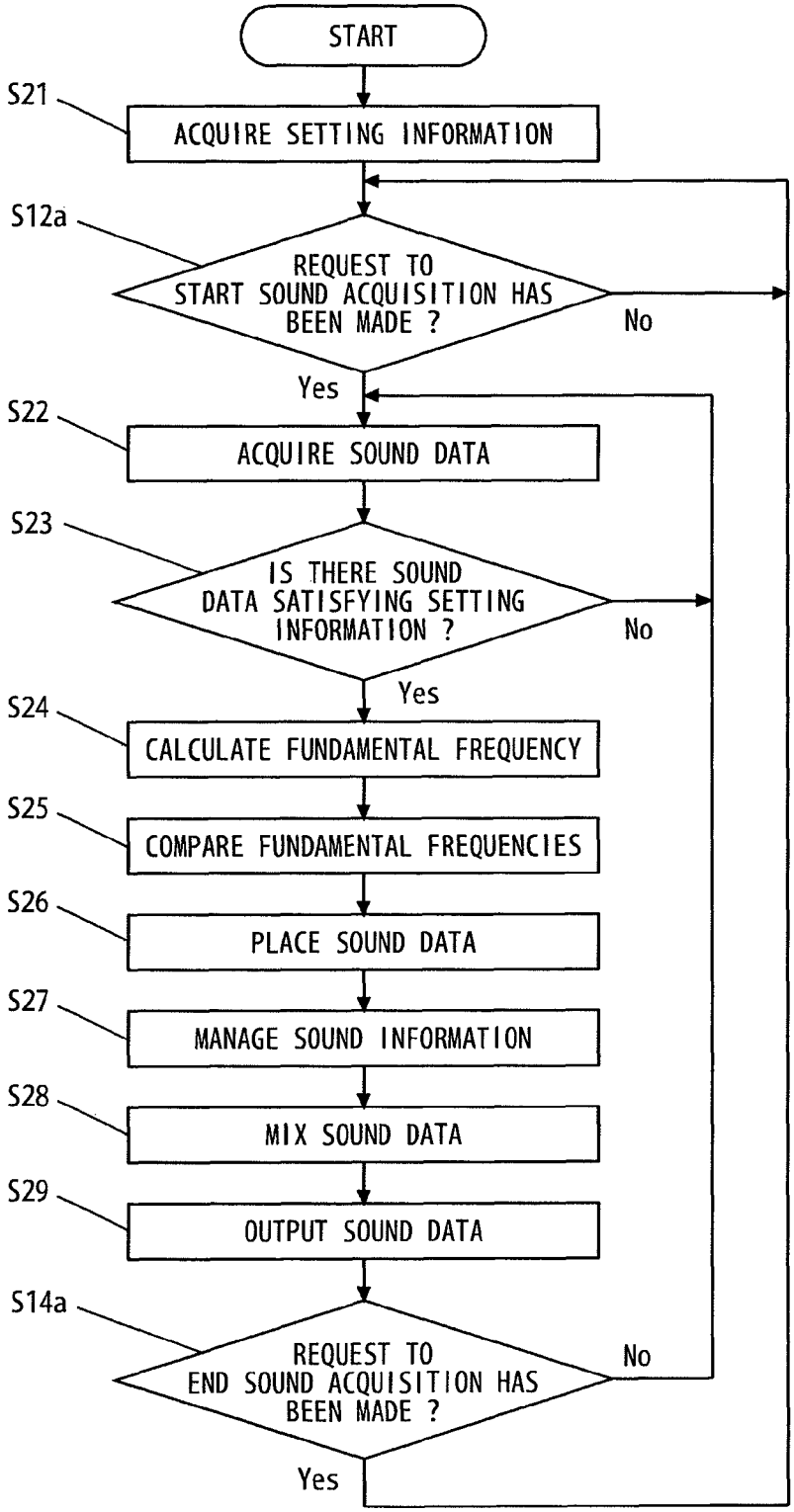
FIG. 9 is a flowchart showing an example of the operations performed by the auditory display apparatus 100 according to the first embodiment of the present invention.

FIG. 9 is a flowchart showing an example of operations that the auditory display apparatus 100 according to the first embodiment performs when mixing sound data inputted from the sound input device 201 and sound data acquired from the sound storage device 203. Referring to FIG. 9, when the auditory display apparatus 100 is activated, the sound transmission/reception section 103 acquires the setting information from the setting storage section 104 (step S21).

Subsequently, the operation input section 101 receives a request from a user to start sound acquisition (step S12*a*). A request to start sound acquisition is made by the user performing an operation, such as pushing a button of the operation input section 101. Alternatively, it may be determined, at the time when a sensor has sensed an input sound, that a request to start sound acquisition has been made. When no request to start sound acquisition has been made (No at step S12*a*), the flow of operations returns to step S12*a*, and the operation input section 101 receives a request to start sound acquisition.

When a request to start sound acquisition has been made (Yes at step S12*a*), the sound input section 102 acquires, from the sound input device 201, a sound that has been converted into an electric signal, converts the acquired sound into numerical data, and outputs the numerical data as sound data to the sound transmission/reception section 103. Thus, the sound transmission/reception section 103 acquires the sound data Y. In addition, the sound transmission/reception section 103 transmits, to the sound storage device 203, the channel number "3" set in the setting storage section 104, and acquires sound data corresponding to the channel number from the sound storage device 203 (step S22).

Subsequently, the sound transmission/reception section 103 determines whether sound data satisfying the setting information has been acquired from the sound storage device 203 (step S23). When the sound transmission/reception section 103 has not acquired sound data satisfying the setting information (No at step S23), the flow of operations returns to step S22. Here, it is assumed that the sound transmission/reception section 103 has acquired, from the sound storage device 203, sound data D as the sound data satisfying the setting information. When the sound data satisfying the setting information has been acquired, the sound analysis section 105 calculates fundamental frequencies of the acquired sound data Y and sound data D (step S24). Next, the sound placement section 106 compares the calculated fundamental frequency of the sound data Y with the calculated fundamental frequency of the sound data D (step S25), and determines placement positions of the acquired sound data Y and sound data D (step S26). The method of determining a placement position of sound data will be described below.

Subsequently, the sound placement section 106 notifies the sound management section 109 of information including the placement positions, output states, and fundamental frequencies of the sound data. The sound management section 109 manages the information provided by the sound placement section 106 (step S27). The operation to be performed at step S27 may be performed after a subsequent step (after step S28 or after step S29). In addition, the sound mixing section 107 mixes the sound data Y and the sound data D which have been placed by the sound placement section 106 (step S28). The sound output section 108 outputs, to the sound output device 202, the sound data Y and the sound data D which have been mixed (step S29). In parallel with this flow, a process of outputting the sound data from the sound output device 202 is separately performed. When the output of the sound data has ended, the information such as the output state managed by the sound management section 109 is updated.

Subsequently, the operation input section 101 receives a request from the user to end sound acquisition (step S14*a*). When no request to end sound acquisition has been made (No at step S14*a*), the flow of operations returns to step S22, and the sound transmission/reception section 103 continues sound data acquisition. Alternatively, the sound transmission/reception section 103 may be configured to automatically end sound acquisition when a predetermined time period has elapsed from the start of sound acquisition. When a request to end sound acquisition has been made (Yes at step S14*a*), the flow of operations returns to step S12*a*, and the operation input section 101 receives a request from the user to start sound acquisition.

Hereinafter, the method of placing sound data will be described with reference to FIGS. 10A to 10D. The sound placement section 106 places sound data in a three-dimensional audio image space including at the center thereof a user 401 who is a listener. Sound data placed in the upward/downward direction and the forward/backward direction with respect to the user 401 is more difficult to clearly recognize than sound data placed in the leftward/rightward direction with respect to the user 401. This is because the position of a sound source is recognized based on movement of the sound source, change in the sound caused by motion of a head, change in the sound reflected by a wall or the like, assistance of visual sense, and the like. It is known that a degree of recognition greatly varies from person to person. Therefore, sound data is placed preferentially in an area 402 extending at a constant height and including positions to the left and the right of, and in front of the user. The sound placement section 106 may place sound data in an area including positions behind, or above and below the user on the assumption that the user can recognize sound data from behind, or above and below him/her.

First, the sound analysis section 105 analyzes sound data, and calculates a fundamental frequency of the sound data. The fundamental frequency can be obtained as the lowest peak frequency in a frequency spectrum that is obtained by Fourier transformation of the sound data. Although depending on circumstances and contents of utterances, a fundamental frequency of sound data is generally around 150 Hz in the case of men, and around 250 Hz in the case of women. For example, it is possible to calculate a representative value by using an average of fundamental frequencies obtained during the first one second.

Figure 10A:
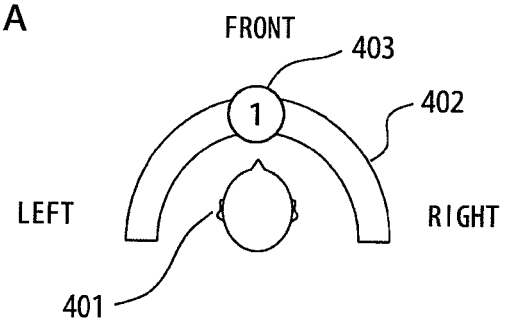
FIG. 10A illustrates a method of placing sound data 403.
Figure 10B:
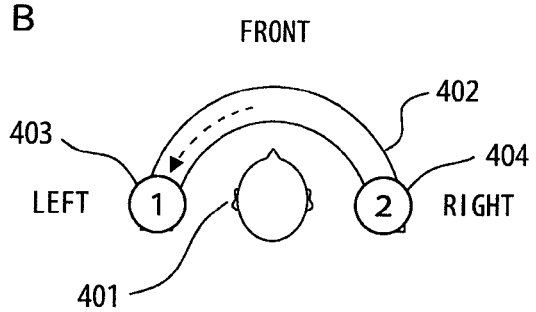
FIG. 10B illustrates a method of placing the sound data 403 and sound data 404.
Figure 10C:
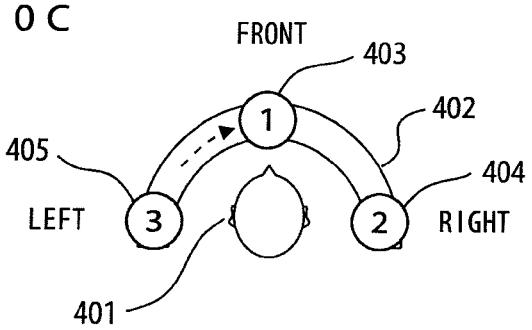
FIG. 10C illustrates a method of placing the sound data 403, the sound data 404, and sound data 405.
Figure 10D:
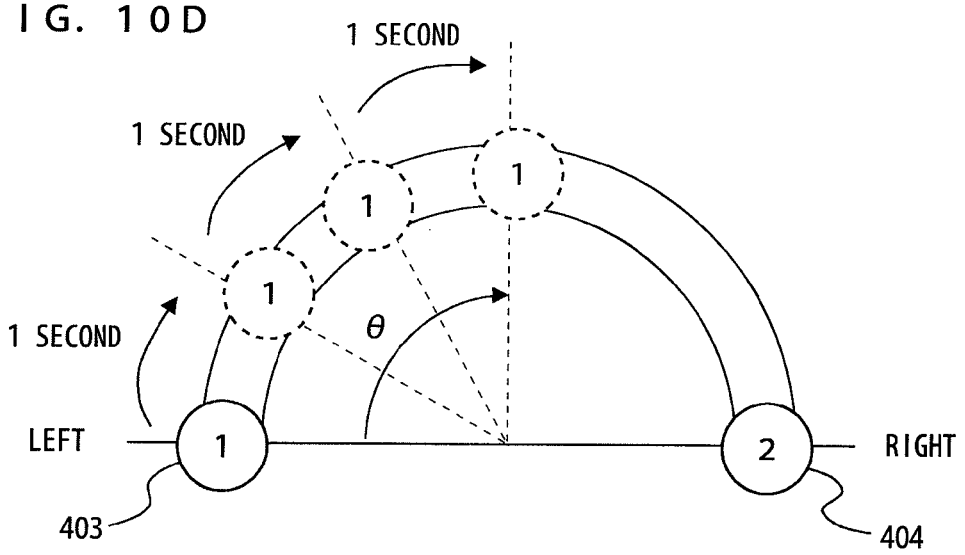
FIG. 10D illustrates the sound data 403 which is being moved stepwise.

When first sound data 403 is placed anew, if other sound data is not being outputted, the sound placement section 106 places the first sound data 403 in front of the user 401 (see FIG. 10A). At this time, the placement position of the first sound data 403 is set such that the azimuth angle is "0 degrees", and the elevation/depression angle is "0 degrees".

In the case of further placing second sound data 404 in addition to the first sound data 403, the sound placement section 106 places the second sound data 404 to the right of the user. The sound placement section 106 moves the first sound data 403 having been placed in front of the user leftward stepwise (see FIG. 10B). Although it is thought that the first sound data 403 and the second sound data 404 can be easily distinguished from each other even when the first sound data 403 is not moved, the first sound data 403 and the second sound data 404 can be distinguished from each other with enhanced ease if they are placed to the left and right of the user, respectively. At this time, the placement position of the first sound data 403 is set such that the azimuth angle is "−90 degrees", and the elevation/depression angle is "0 degrees". The placement position of the second sound data 404 is set such that the azimuth angle is "90 degrees", and the elevation/depression angle is "0 degrees". In order to simplify explanation, the relative distances for each sound data are the same in this example.

In the description below, consideration is given to placement positions in the case where third sound data 405 is further placed in addition to the first sound data 403 and the second sound data 404. Possible placement positions in this case are the following three ones. The first possible position is (A) a position to the left of the first sound data 403 which has been placed to the left of the user. The second possible position is (B) a position between the first sound data 403 which has been placed to the left of the user and the second sound data 404 which has been placed to the right of the user. The third possible position is (C) a position to the right of the second sound data 404 which has been placed to the right of the user.

For example, it is assumed that the fundamental frequencies of the first sound data 403, the second sound data 404, and the third sound data 405 are 150 Hz, 250 Hz, and 220 Hz, respectively. The sound placement section 106 calculates a difference in fundamental frequency between the third sound data 405 which is to be additionally placed, and each of the first sound data 403 and the second sound data 404 which have been already placed and will be close to the third sound data 405. In the case of (A), the third sound data 405 and the first sound data 403 are compared with each other, and the difference in fundamental frequency is 70 Hz. In the case of (B), the third sound data 405 and the first sound data 403 are compared with each other, and the difference in fundamental frequency is 70 Hz, and the third sound data 405 and the second sound data 404 are also compared with each other, and the difference in fundamental frequency is 30 Hz. In the case of (C), the third sound data 405 and the second sound data 404 are compared with each other, and the difference in fundamental frequency is 30 Hz. When sound data is placed between sound data corresponding to two sounds, two values each representing a difference in fundamental frequency are obtained. In this case, the smaller value is adopted. That is, the differences in fundamental frequency are 70 Hz, 30 Hz, and 30 Hz in the case of (A), (B), and (C), respectively. The maximal difference in fundamental frequency is 70 Hz in the case of (A).

As described above, the sound placement section 106 compares the fundamental frequency of the third sound data 405 which is to be additionally placed with the fundamental frequency of sound data that is close to the third sound data 405, and then determines the placement position of sound data such that the difference in fundamental frequency is maximized. Accordingly, the placement position of the third sound data 405 is (A) a position to the left of the first sound data 403 which has been placed to the left of the user. When having determined the placement position, the sound placement section 106 moves the first sound data 403 to the middle position, that is, to the front of the user. At this time, the sound placement section 106 may move the first sound data 403 stepwise (see FIG. 10C).

Moving sound data stepwise means moving the sound data such that the position of the sound data changes stepwise between one position and another. For example, when sound data is moved by θ in n seconds, the sound data is moved by θ/n per second (see FIG. 10D). In an example in which the position of the first sound data 403 is changed such that the azimuth angle is changed from −90 degrees to 0 degrees in three seconds, θ is 90 degrees, and n is three. Moving sound data stepwise allows the user 401 to feel as if the sound source generating the sound data is actually moving. In addition, moving sound data stepwise prevents the user 401 from being confused by rapid movement of the sound data.

For the case where there are a plurality of positions at which the difference in fundamental frequency is maximized, a rule may be previously set which stipulates, for example, that sound data is placed at a rightmost position among the plurality of positions. Further, when sound data is moved stepwise, if each sound source of the sound data is moved stepwise such that the positions of the sound data are located at regular intervals after placement, the sound data can be distinguished from each other with enhanced ease.

Also when placing fourth sound data (not shown) in addition to the first to third sound data 403 to 405, the sound placement section 106 places the sound data in the same manner as described above. Specifically, the sound placement section 106 calculates the difference in fundamental frequency between the fourth sound data and sound data that is close to the fourth sound data, and places the fourth sound data at a position at which the difference is maximized. When fundamental frequencies of sound data to be placed are equal to each other, the sound management section 109 may perform frequency conversion for the sound data to change the fundamental frequencies. In addition, if the sound management section 109 performs frequency conversion for sound data, the privacy of a sender of the sound data can be protected.

Meanwhile, it is desirable that when output of any sound data has ended, the sound placement section 106 moves stepwise sound data being outputted such that the sound data being outputted are placed at regular intervals. In this case, it is conceivable that the difference in fundamental frequency between sound data placed to both sides of the sound data of which the output has ended may be small. For such a case, a rule may be previously set which stipulates, for example, that the sound data to the left side is placed again in the same manner as described above. Examples of the method of determining sound data to be placed again include a method of giving priority to sound data which has been added earlier or sound data which has been added later, and a method of giving priority to sound data which will continue to be outputted for longer time period or sound data which will continue to be outputted for shorter time period. Sound data placement may be performed again when the distance between placement positions is smaller than a predetermined threshold value. Alternatively, sound data placement may be performed again when the ratio of the maximum value to the minimum value of the distance between placement positions, or the difference between the maximum value and the minimum value, is greater than a predetermined threshold value.

In the present embodiment, a case has been described where sound data are placed in an area including positions to the left and right of, and in front of the user which are at the same distance from the user, in consideration of the characteristics of auditory sense. However, in some cases, the sound placement section 106 can make it easier to recognize sound data placed in the forward/backward direction and the upward/downward direction by adding an effect such as reverberation and attenuation to the sound data. In such cases, the sound placement section 106 may place sound data on a spherical surface in a three-dimensional audio image space.

In the case where the sound placement section 106 places sound data on a spherical surface in a three-dimensional audio image space, the sound placement section 106 calculates, for each sound data, other sound data that is placed closest thereto. Subsequently, the sound placement section 106 repeatedly performs a process of moving each sound data stepwise away from sound data that is placed closest thereto, thereby placing sound data on a spherical surface. In this case, if the difference in fundamental frequency between sound data placed closest to each other is small, the moving distance may be increased. If the difference in fundamental frequency between the sound data placed closest to each other is large, the moving distance may be reduced.

The sound placement section 106 may acquire, from the operation input section 101, a direction in which the auditory display apparatus 100 faces, and may change a placement position of sound data in accordance with the direction in which the auditory display apparatus 100 faces. That is, when the auditory display apparatus 100 is caused to face toward certain sound data, the sound placement section 106 may place again the certain sound data in front of the user. In addition, the sound placement section 106 may change the distance between the user and the certain sound data such that the certain sound data is placed relatively close to the user. The direction in which the auditory display apparatus 100 faces may be acquired by means of, for example, various kinds of sensors such as a camera and an electronic compass.

As described above, the auditory display apparatus 100 according to the embodiment of the present invention places sound data corresponding to a plurality of sounds such that the difference between sound data adjacent to each other is large, thereby enabling desired sound data to be easily recognized.

Second Embodiment

Figure 11A:
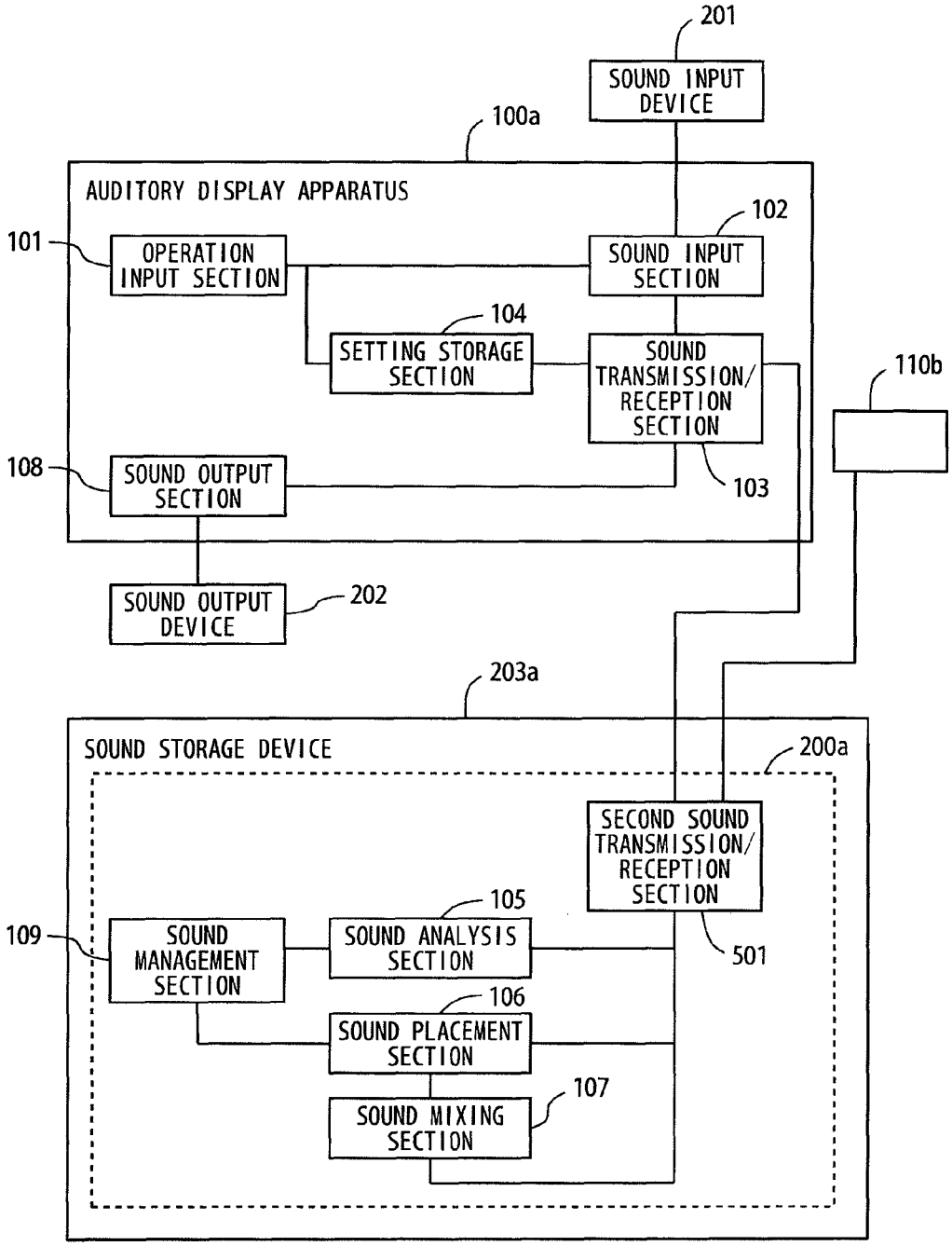
FIG. 11A is a block diagram showing an exemplary configuration of a sound storage device 203*a* according to a second embodiment of the present invention.

A second embodiment is different from the first embodiment in that an auditory display apparatus 100*a* does not include components for the sound placement processing section, and the sound placement processing section is included in a sound storage device 203*a*. FIG. 11A is a block diagram showing an exemplary configuration of the sound storage device 203*a* according to the second embodiment of the present invention. Hereinafter, the same components as those in FIG. 1 are denoted by the same reference characters, and repeated descriptions are omitted. The auditory display apparatus 100*a* has a configuration obtained by removing the sound management section 109, the sound analysis section 105, the sound placement section 106, and the sound mixing section 107, from the configuration shown in FIG. 1. By using the sound output section 108, the auditory display apparatus 100*a* outputs, through the sound output device 202, sound data received by the sound transmission/reception section 103 from the sound storage device 203*a*.

The sound storage device 203*a* further includes a second sound transmission/reception section 501, in addition to the sound management section 109, the sound analysis section 105, the sound placement section 106, and the sound mixing section 107 shown in FIG. 1. The sound management section 109, the sound analysis section 105, the sound placement section 106, the sound mixing section 107, and the second sound transmission/reception section 501 form a sound placement processing section 200*a*. The sound placement processing section 200*a* determines a placement position of sound data received from the auditory display apparatus 100*a*, mixes the sound data with sound data received from another apparatus 110*b*, and transmits the sound data obtained by the mixture to the auditory display apparatus 100*a*. The number of other apparatuses 100*b* may be plural. The second sound transmission/reception section 501 transmits and receives sound data to and from the auditory display apparatus 100*a* and the like. The method of determining a placement position of sound data and the method of mixing sound data in the sound placement processing section 200*a* are the same as those in the first embodiment.

The sound transmission/reception section 103 transmits an identifier for identifying the auditory display apparatus 100*a*. The second sound transmission/reception section 501 may receive the identifier from the sound transmission/reception section 103, and the sound management section 109 may manage the identifier and a placement position of sound data, so as to be associated with each other. Thus, even when sound data is temporarily interrupted, the sound placement processing section 200*a* can determine that sound data associated with the same identifier is sound data from the same speaking person, and thus can place the sound data at the same position.

Figure 11B:
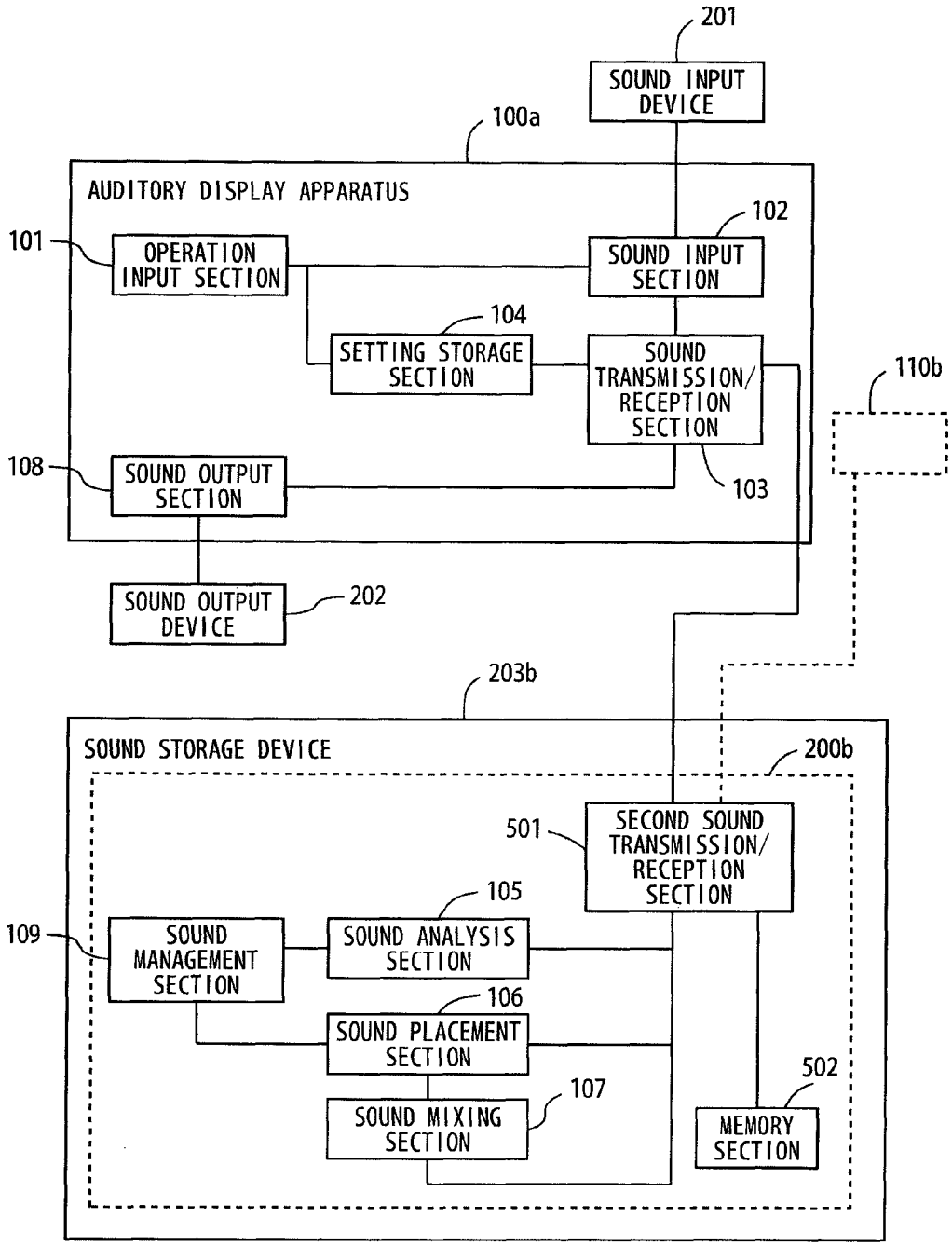
FIG. 11B is a block diagram showing an exemplary configuration of a sound storage device 203*b* according to the second embodiment of the present invention.

A sound placement processing section 200*b* included in a sound storage device 203*b* according to the second embodiment may further include a memory section 502 capable of storing sound data, as shown in FIG. 11B. For example, the memory section 502 can store information as shown in FIG. 4A and FIG. 4B. The sound placement processing section 200*b* determines a placement position of sound data received from the auditory display apparatus 100*a*, and mixes the sound data with sound data acquired from the memory section 502. Alternatively, the sound placement processing section 200*b* may acquire, from the memory section 502, sound data corresponding to a plurality of sounds, determine placement positions of the acquired sound data corresponding to the plurality of sounds, and mix the acquired sound data corresponding to the plurality of sounds. The sound placement processing section 200*b* transmits the sound data obtained by the mixture to the auditory display apparatus 100*a*. The second sound transmission/reception section 501 can also receive sound data from not only the auditory display apparatus 100*a* and the memory section 502 but also another apparatus 110*b*.

As described above, the sound placement processing sections 200*a, b* according to the embodiment of the present invention stereophonically place sound data corresponding to a plurality of sounds such that the difference between sound data adjacent to each other is large, thereby enabling desired sound data to be easily recognized.

Third Embodiment

Figure 12A:
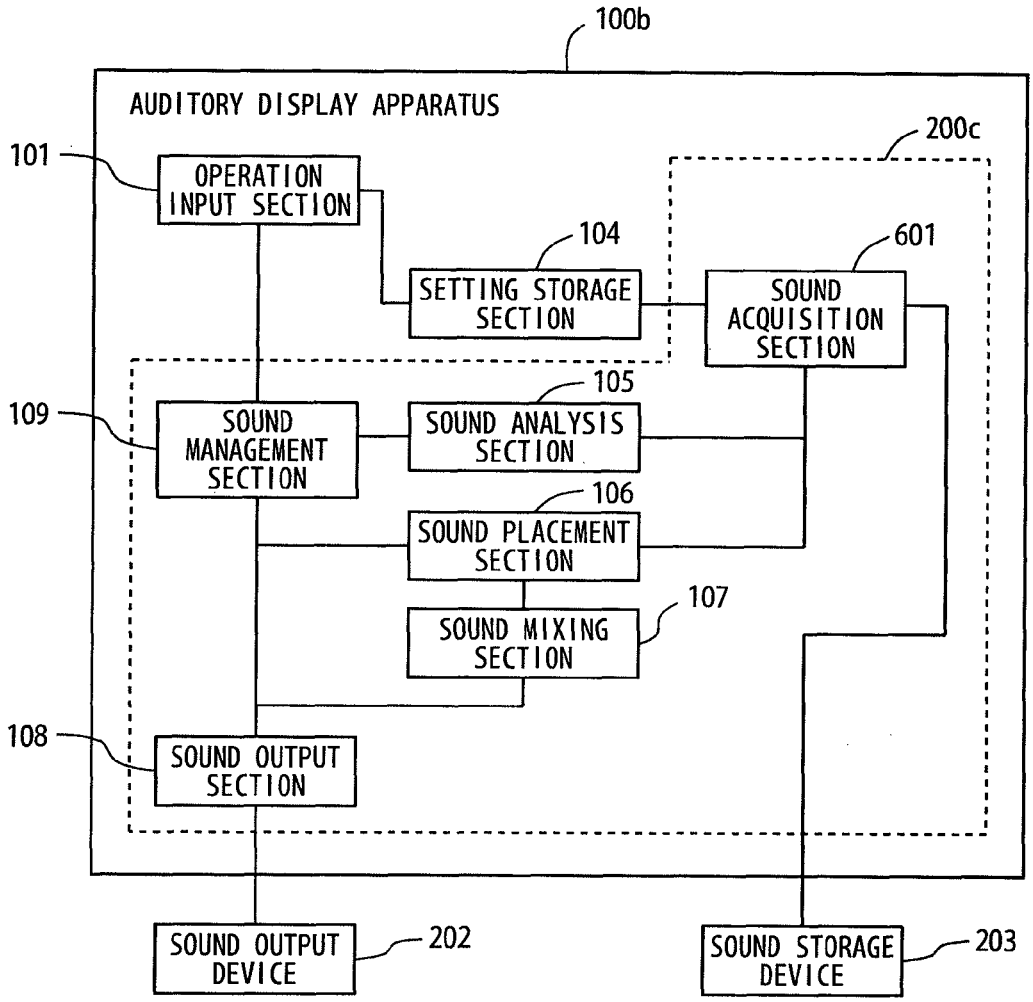
FIG. 12A is a block diagram showing an exemplary configuration of an auditory display apparatus 100*b* according to a third embodiment of the present invention.
Figure 12B:
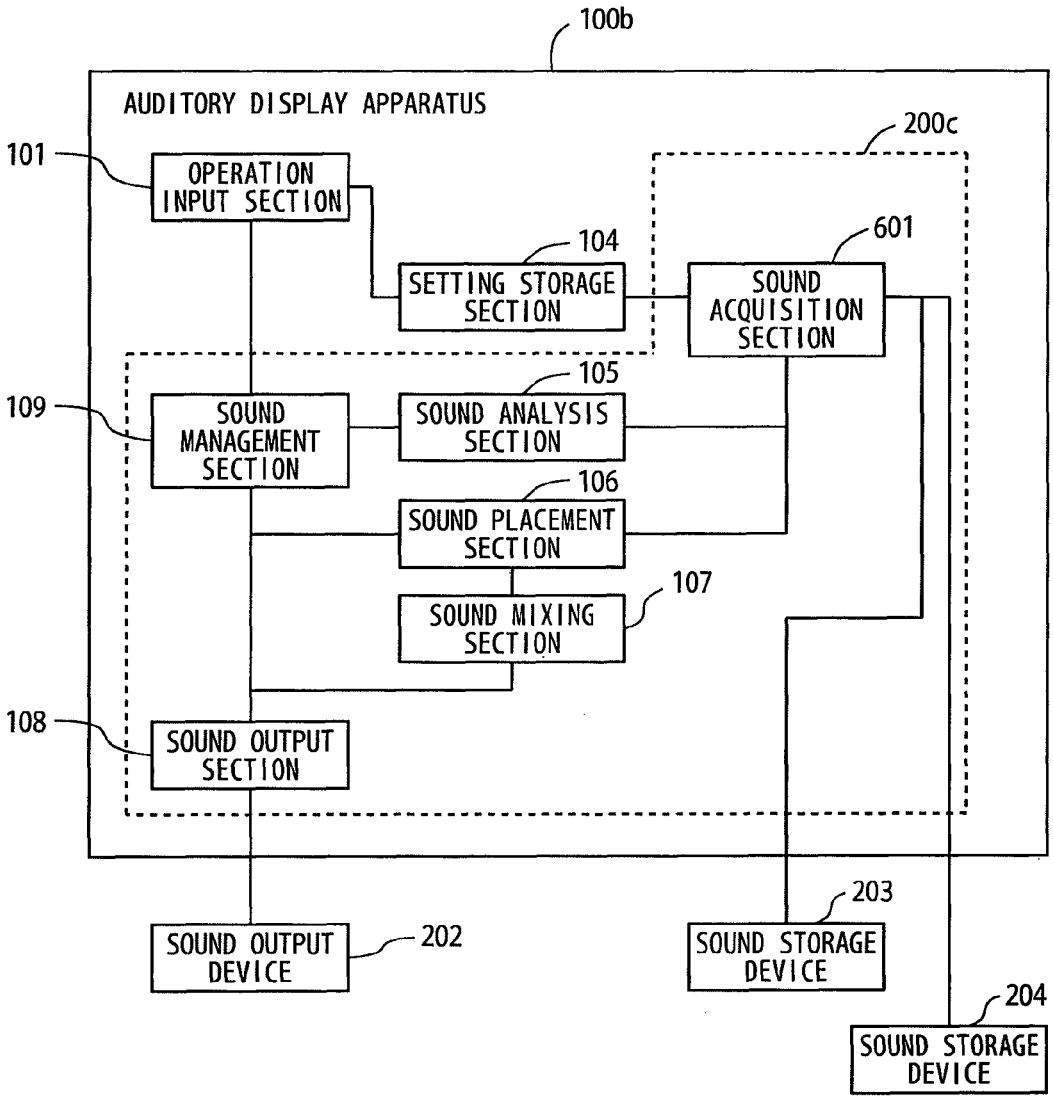
FIG. 12B is a block diagram showing an exemplary configuration of the auditory display apparatus 100*b* connected to a plurality of sound storage devices 203 and 204.

FIG. 12A is a block diagram showing an exemplary configuration of an auditory display apparatus 100*b* according to a third embodiment of the present invention. Hereinafter, the same components as those in FIG. 1 are denoted by the same reference characters, and repeated descriptions are omitted. The third embodiment of the present invention is different from the embodiment shown in FIG. 1 in that the third embodiment does not include the sound input device 201 and the sound input section 102. In addition, the auditory display apparatus 100*b* includes a sound acquisition section 601 instead of the sound transmission/reception section 103. The sound acquisition section 601 acquires sound data from the sound storage device 203. As shown in FIG. 12B, the auditory display apparatus 100*b* may be connected to a plurality of sound storage devices 203 and 204, and may acquire, from the plurality of sound storage devices 203 and 204, sound data corresponding to a plurality of sounds.

A sound placement processing section 200*c* includes the sound acquisition section 601, the sound analysis section 105, the sound placement section 106, the sound mixing section 107, the sound output section 108, and the sound management section 109. That is, the auditory display apparatus 100*b* according to the third embodiment does not have a function of transmitting sound data, and has a function of stereophonically placing received sound data. If the function of the auditory display apparatus 100*b* is limited in this manner, the auditory display apparatus 100*b* can perform one-way audio communication that provides sound data corresponding to a plurality of sounds is enabled, and the configuration can be simplified.

Fourth Embodiment

Figure 13:
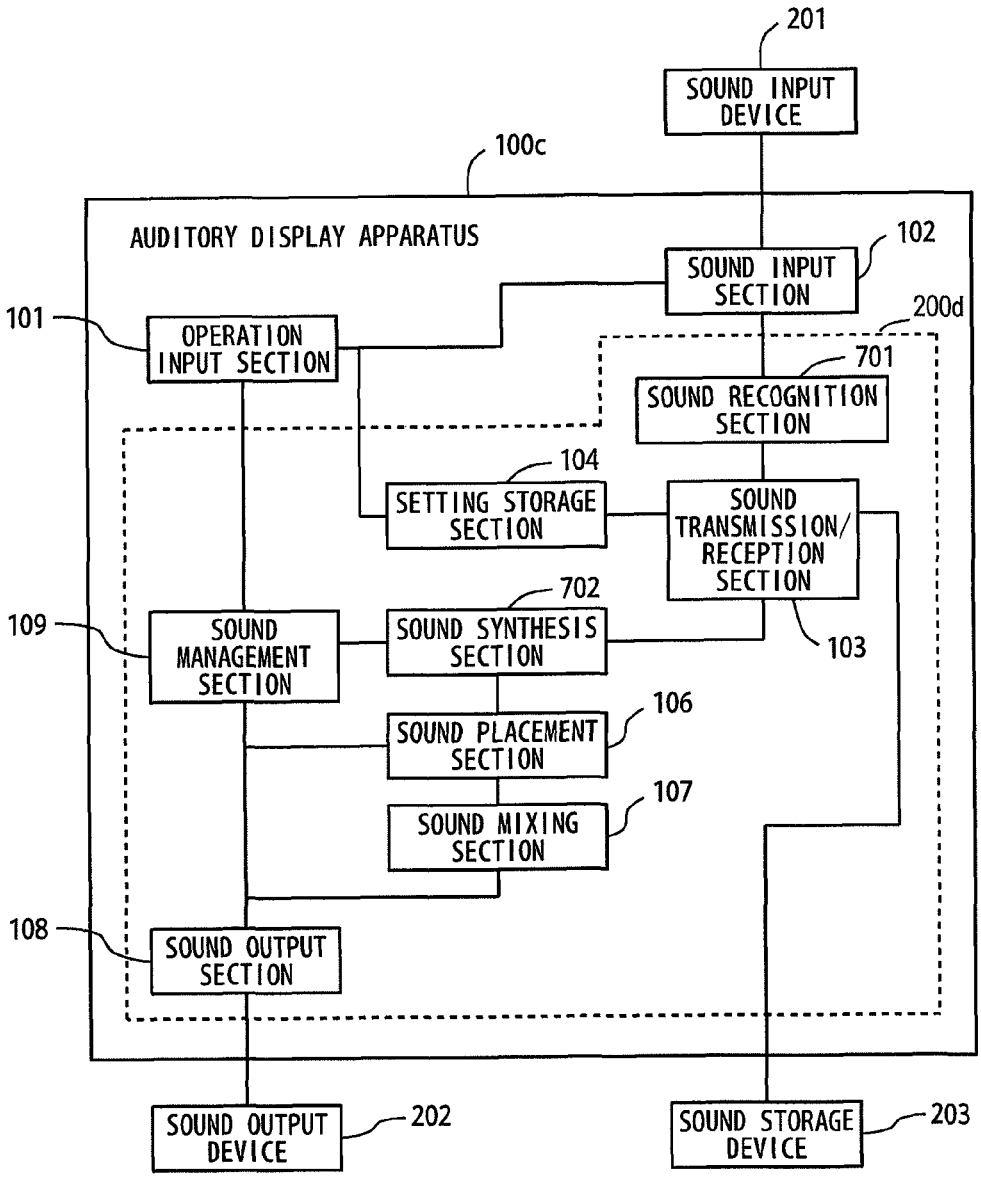
FIG. 13 is a diagram showing a configuration of an auditory display apparatus 100*c* according to a fourth embodiment of the present invention.

FIG. 13 is a diagram showing a configuration of an auditory display apparatus 100*c* according to a fourth embodiment of the present invention. Hereinafter, the same components as those in FIG. 1 are denoted by the same reference characters, and repeated descriptions are omitted. The auditory display apparatus 100*c* according to the fourth embodiment of the present invention is different from the auditory display apparatus 100 shown in FIG. 1 in that the auditory display apparatus 100*c* further includes a sound recognition section 701, and includes a sound synthesis section 702 instead of the sound analysis section 105. A sound placement processing section 200*d* includes the sound recognition section 701, the sound transmission/reception section 103, the sound synthesis section 702, the sound placement section 106, the sound mixing section 107, the sound output section 108, and the sound management section 109.

The sound recognition section 701 receives sound data from the sound input section 102, and converts an utterance into character code based on a waveform of the received sound data. In addition, the sound recognition section 701 analyzes the sound data, and calculates a fundamental frequency of the sound data. The sound transmission/reception section 103 receives the character code and the fundamental frequency of the sound data from the sound recognition section 701, and outputs them to the sound storage device 203. The sound storage device 203 stores the character code and the fundamental frequency of the sound data. Further, the sound transmission/reception section 103 receives the character code and the fundamental frequency of the sound data from the sound storage device 203.

The sound synthesis section 702 synthesizes sound data from the character code, based on the fundamental frequency. The sound placement section 106 determines a placement position of the sound data such that the difference in fundamental frequency between the sound data and adjacent sound data is maximized. As described above, according to the present embodiment, a configuration can be realized that allows sound data to be handled as character code and also allows the sound data to be heard, by using sound recognition and sound synthesis. Further, in the present embodiment, since sound data is handled as character code, the amount of data to be handled can be greatly reduced.

Instead of using a fundamental frequency obtained by analysis of sound data, the sound placement section 106 may calculate an optimal fundamental frequency anew. For example, the sound placement section 106 may calculate a fundamental frequency of sound data within the audible range of people such that the difference in fundamental frequency between sound data adjacent to each other is large. In this case, the sound synthesis section 702 synthesizes the sound data from character code, based on the fundamental frequency which has been calculated anew by the sound placement section 106.

The functions of the auditory display apparatuses according to the embodiments of the present invention may be realized by a CPU interpreting and executing predetermined program data which is capable of executing process steps stored in a storage device (ROM, RAM, hard disk, etc.). In this case, the program data may be loaded to the storage device via a storage medium, or may be directly executed in the storage medium. Examples of the storage medium include: semiconductor memories such as a ROM, a RAM, and a flash memory; magnetic disk memories such as a flexible disk and a hard disk; optical disk memories such as a CD-ROM, a DVD, and a BD; and a memory card. The storage medium is a concept including communication media such as a telephone line and a transmission line.

Each functional block included in the auditory display apparatuses disclosed in the embodiments of the present invention may be realized as an LSI which is an integrated circuit. For example, the sound transmission/reception section 103, the sound analysis section 105, the sound placement section 106, the sound mixing section 107, the sound output section 108, and the sound management section 109 in the auditory display apparatus 100 may be configured as an integrated circuit. Each of these functional blocks may be individually realized on a single chip; or a part or all of these functional blocks may be realized on a single chip. The LSI may be referred to as an IC, a system LSI, a super LSI, or an ultra LSI, depending on difference in the degree of integration.

Furthermore, the means for integration is not limited to an LSI, and may be realized through circuit-integration of a dedicated circuit or a general-purpose processor. An FPGA (Field Programmable Gate Array), which is programmable after production of an LSI, and a reconfigurable processor in which the connection and the setting of a circuit cell inside an LSI are reconfigurable, may be used. Still further, a configuration may be used in which a hardware source includes a processor, a memory, and the like, and the processor executes a control program stored in a ROM.

Furthermore, if technology for circuit integration replacing the LSI is introduced with an advance in semiconductor technology or a derivation from other technology, obviously, such technology may be used for the integration of the functional block. Biotechnology or the like will be possibly applied.

INDUSTRIAL APPLICABILITY

The auditory display apparatus according to the present invention is useful, for example, for a mobile terminal intended for voice communication performed by a plurality of users. Further, the auditory display apparatus according to the present invention is applicable to mobile phones, personal computers, music players, car navigation systems, television conference systems, and the like.

DESCRIPTION OF THE REFERENCE CHARACTERS

100, 100*a*, 100*b*, 100*c* auditory display apparatus
101 operation input section
102 sound input section
103 sound transmission/reception section
104 setting storage section
105 sound analysis section
106 sound placement section
107 sound mixing section
108 sound output section
109 sound management section
110*b* another apparatus
200, 200*a*, 200*b* sound placement processing section
201 sound input device
202 sound output device
203, 204, 203*a*, 203*b* sound storage device
401 user (listener)
402 sound placement area
403 first sound data
404 second sound data
405 third sound data
501 second sound transmission/reception section
502 memory section
601 sound acquisition section
701 sound recognition section
702 sound synthesis section

The invention claimed is:

1. An auditory display apparatus connected to an sound output device, the auditory display apparatus comprising:

a sound transmission/reception section configured to receive sound data;

a sound analysis section configured to analyze the sound data, and calculate a fundamental frequency of the sound data;

a sound placement section configured to compare the fundamental frequency of the sound data with a fundamental frequency of adjacent sound data, and place the sound data such that a difference in fundamental frequency is maximized;

a sound management section configured to manage a placement position of the sound data;

a sound mixing section configured to mix the sound data with the adjacent sound data; and a sound output section configured to output the sound data obtained by the mixture to the sound output device.

2. The auditory display apparatus according to claim 1, wherein the sound management section manages the placement position of the sound data and sound source information of the sound data in combination with each other, and if the sound placement section has determined, based on the sound source information, that the sound data received by the sound transmission/reception section is identical to the sound data managed by the sound management section, the sound placement section places the received sound data at the same placement position as that of the sound data managed by the sound management section.

3. The auditory display apparatus according to claim 1, wherein the sound management section manages the placement position of the sound data and sound source information of the sound data in combination with each other, and the sound placement section places the sound data such that the sound placement section excludes, based on the sound source information, sound data that has been received from a specific input source.

4. The auditory display apparatus according to claim 1, wherein the sound management section manages the placement position of the sound data and an input time of the sound data in combination with each other, and the sound placement section places the sound data based on the input time of the sound data.

5. The auditory display apparatus according to claim 1, wherein when the sound placement section changes the placement position of the sound data, the sound placement section moves the sound data from a movement start position to a movement destination such that the position of the sound data changes stepwise between the movement start position and the movement destination.

6. The auditory display apparatus according to claim 1, wherein the sound placement section places the sound data preferentially in an area including positions to the left and right of a user, and in front of the user.

7. The auditory display apparatus according to claim 6, wherein the sound placement section places the sound data in an area including positions behind, or above and below the user.

8. The auditory display apparatus according to claim 1, wherein the auditory display apparatus is connected to a sound storage device in which sound data corresponding to one or more sounds are stored and which manages the sound data corresponding to the one or more sounds based on channels, and the auditory display apparatus further comprises:

an operation input section configured to receive an input for switching the channels; and a setting storage section configured to store a channel set by the switching, and the sound transmission/reception section acquires sound data corresponding to the channel from the sound storage device.

9. The auditory display apparatus according to claim 1, further comprising an operation input section configured to acquire a direction in which the auditory display apparatus faces, wherein the sound placement section changes the placement position of the sound data in accordance with change in the direction in which the auditory display apparatus faces.

10. An auditory display apparatus connected to a sound output device, the auditory display apparatus comprising:

a sound recognition section configured to convert sound data into character code, and calculate a fundamental frequency of the sound data;

a sound transmission/reception section configured to receive the character code and the fundamental frequency of the sound data;

a sound synthesis section configured to synthesize the sound data from the character code, based on the fundamental frequency;

a sound placement section configured to compare the fundamental frequency of the sound data with a fundamental frequency of adjacent sound data, and place the sound data such that a difference in fundamental frequency is maximized;

a sound management section configured to manage a placement position of the sound data;

a sound mixing section configured to mix the sound data with the adjacent sound data; and a sound output section configured to output the sound data obtained by the mixture via the sound output device.

11. A sound storage device connected to an auditory display apparatus, the sound storage device comprising:

a sound transmission/reception section configured to receive sound data;

a sound analysis section configured to analyze the sound data, and calculate a fundamental frequency of the sound data;

a sound placement section configured to compare the fundamental frequency of the sound data with a fundamental frequency of adjacent sound data, and place the sound data such that a difference in fundamental frequency is maximized;

a sound management section configured to manage a placement position of the sound data;

a sound mixing section configured to mix the sound data with the adjacent sound data, and transmit the sound data obtained by the mixture to the auditory display apparatus via the sound transmission/reception section.

12. A method performed by an auditory display apparatus connected to a sound output device, the method comprising:

a sound reception step of receiving sound data;

a sound analysis step of analyzing the received sound data, and calculating a fundamental frequency of the sound data;

a sound placement step of comparing the fundamental frequency of the sound data with a fundamental frequency of adjacent sound data, and placing the sound data such that a difference in fundamental frequency is maximized;

a sound mixing step of mixing the sound data with the adjacent sound data; and a sound output step of outputting the sound data obtained by the mixture to the sound output device.

13. A non-transitory computer-readable medium having a program stored thereon, the program being executed by an auditory display apparatus connected to a sound output device, the program executing:

a sound reception step of receiving sound data;

a sound analysis step of analyzing the received sound data, and calculating a fundamental frequency of the sound data;

a sound placement step of comparing the fundamental frequency of the sound data with a fundamental frequency of adjacent sound data, and placing the sound data such that a difference in fundamental frequency is maximized;

a sound mixing step of mixing the sound data with the adjacent sound data; and a sound output step of outputting the sound data obtained by the mixture to the sound output device.

* * * * *